United States Patent [19]

Levenback et al.

[11] 4,011,101

[45] Mar. 8, 1977

[54] DISHWASHER-WASH HOOD SYSTEM AND METHOD OF OPERATION

[75] Inventors: George Levenback, Studio City; Ronald Aaron Marks, Canoga Park, both of Calif.

[73] Assignee: Elsters Inc., Los Angeles, Calif.

[22] Filed: July 28, 1975

[21] Appl. No.: 599,600

[52] U.S. Cl. ..... 134/10; 98/115 K; 134/18; 134/29; 134/56 D; 134/95; 134/98; 134/115 R

[51] Int. Cl.[2] ..... B08B 3/00; B08B 13/00

[58] Field of Search ..... 134/18, 10, 25 A, 29, 134/56 D, 57 D, 95, 98, 103, 115 R; 98/115 K; 169/65

[56] References Cited

UNITED STATES PATENTS

| | | | |
|---|---|---|---|
| 3,034,519 | 5/1962 | Jacobs | 134/95 |
| 3,564,989 | 2/1971 | Williams | 98/115 K |
| 3,628,311 | 12/1971 | Costrarella et al. | 98/115 K X |
| 3,785,124 | 1/1974 | Gaylord | 98/115 K |
| 3,795,181 | 3/1974 | Lawson | 98/115 K |

*Primary Examiner*—Robert L. Lindsay, Jr.
*Assistant Examiner*—Richard V. Fisher
*Attorney, Agent, or Firm*—Spensley, Horn & Lubitz

[57] ABSTRACT

A washing system combines a dishwashing assembly and a washable kitchen exhaust hood assembly by means of common use of a sump and pump. The pump selectively communicates with the dishwashing assembly and exhaust hood assembly through a bypass valve or diverting valve assembly having an input and two outputs. An exhaust fan connected by means of a duct system to the exhaust hood assembly is disenabled. The sump is filled with a detergent solution and the pump is activated to distribute the detergent solution within the washable exhaust hood assembly. A control means sequences additional valving to operate through a plurality of wash, rinse, and flush cycles. After the hood wash cycles are completed, the exhaust fan is activated and the bypass valve or diverting valve assembly is selectively activated to cause the pump and sump together with additional controlled valving, to sequence and operate the dishwashing assembly.

17 Claims, 3 Drawing Figures

| | WASH CYCLE | | | RINSE CYCLE | | | FLUSH CYCLE | | |
|---|---|---|---|---|---|---|---|---|---|
| VALVE # | FILL | WASH | DRAIN | FILL | RINSE | DRAIN | FLUSH | DRAIN | FINISH |
| 38, 138 | O | C | C | C | C | C | C | C | C |
| 36, 136 | O | C | C | O | C | C | C | C | C |
| 30, 130 | O | O | C | C | O | C | C | C | C |
| 131 | C | O | C | C | O | C | C | C | C |
| 34, 134 | C | C | O | C | C | O | O | O | C |
| 32, 132 | C | C | C | C | C | C | O | C | C |
| 60 FANS 160 | O | X | O | O | X | O | X | X | O |

VALVE: O = OPEN C = CLOSED FAN: O = ON X = OFF

DISHWASHER-WASH HOOD SYSTEM AND METHOD OF OPERATION

BACKGROUND OF THE INVENTION

1. Field of the Invention

The present invention relates to the field of commercial washing apparatus. More particularly, the present invention relates to the field wherein various commercial washing apparatus may be combined into an integrated system.

2. Prior Art

Construction and operation of commercial dishwashing apparatus is well known to the art. The basic elements of a dishwashing or other automated washing assembly include a means for distributing a fluid under pressure within an enclosure and a sump for collecting the distributed fluid. More specifically, a detergent and hot water are disposed into the sump to a pre-selected level. A pump then circulates the detergent solution from the sump to an array of jet nozzles, typically mounted on a rotating arm. This wash cycle is followed by a rinse cycle with clean hot water. The sump may be coupled to the drain through a selectively activated valve. A control means coordinate the operation of the detergent fill valve, the hot water fill valve, the drain valve, and the pump is a sequence as determined by the desired application. Any or all of these operations may also be manually operated and/or controlled.

Most large commercial cooking appliances are used in combination with an exhaust hood. The exhaust hood provides means whereby smoke, grease, and hot vapors are drawn from the space above the cooking apparatus and suitably exhausted. In many applications, it is desirable to periodically cleanse the interior of the exhaust hood by an integral wash system. The hood wash assembly may incorporate many of the basic features which are also typically incorporated in a dishwashing assembly, namely, a pump, a sump, a means for distributing fluid under pressure within the enclosure of the exhaust hood, and suitable valving controlled by a control means for coordinating the operation of the pump and valving. In most applications it is desirable to wash the exhaust hood daily in order to maintain the efficient operation of the exhaust hood, maintain cleanliness within the exhaust hood, and to minimize fire hazard within the exhaust hood.

Typically, users who have a commercial dishwasher almost invariably also have an exhaust hood wherein a wash hood assembly may be incorporated. In the prior art, these two apparatus were never combined into a single system, and each maintained its separate plumbing circuit, valving, pumping and control means. Also, in the prior art, washing of the exhaust hood did not remove grease and other foreign matter from the dust system. Ducts required cleaning by scraping the accumulation manually from the surfaces. This is a laborious and costly process which is disturbing to the normal kitchen operation. Therefore, what is needed is a single system which is designed and adapted to meet the performance requirements of both a dishwashing assembly and a wash hood assembly wherein a single control means, pump, and associated valving may be employed, and which is capable of washing the duct system and fan as well as the hood, when necessary.

BRIEF SUMMARY OF THE INVENTION

The present invention is a washing system which combines a dishwashing assembly, a wash hood assembly, and a control means for controlling, sequencing, and coordinating the operation of the dishwashing assembly and wash hood assembly. The dishwashing assembly has an enclosure and a first means for distributing fluid under pressure within the enclosure. The wash hood assembly is connected to an exhaust duct, and an exhaust fan, and contains a second means for distributing fluid under pressure within the hood, and, when desired, the exhaust duct, and the exhaust fan. The wash hood assembly may also include a means for providing make-up air to replace air which is exhausted through the exhaust duct by the exhaust fan. A sump, which may be part of the dishwashing machine, communicates with the wash hood assembly to provide a receptacle for fluid drained from the exhaust hood and duct. The input port of a pump communicates with the sump and has its output port communicating with a bypass valve or a diverting valve assembly. There is also a means for disposing solid or liquid detergent within the sump, a source of hot water communicating with the sump through a hot water fill valve, and a drain communicating with the sump through a drain valve. The bypass valve or diverting valve assembly has an input and two outputs. The input communicates with the output of the pump while one output of the bypass valve communicates with a means for distributing fluid within the dishwashing assembly and the other output of the bypass valve communicates with a second means for distributing fluid within the wash hood assembly. A hot water flushing source also communicates with the means for distributing fluid. Finally, a control means is coupled to the pump, the exhaust fan, bypass or diverting valve assembly, drain valve, hot water fill valve, hot water flush valve, and the means for disposing detergent within the sump. The operation of these devices are coordinated by the control means to selectively activate the same through one of a plurality of sequences which will selectively wash, rinse, and flush either the wash hood assembly or the dishwashing assembly according to the preselected cycle.

DETAILED DESCRIPTION OF THE PREFERRED EMBODIMENTS

Figures 1, 2, 3:
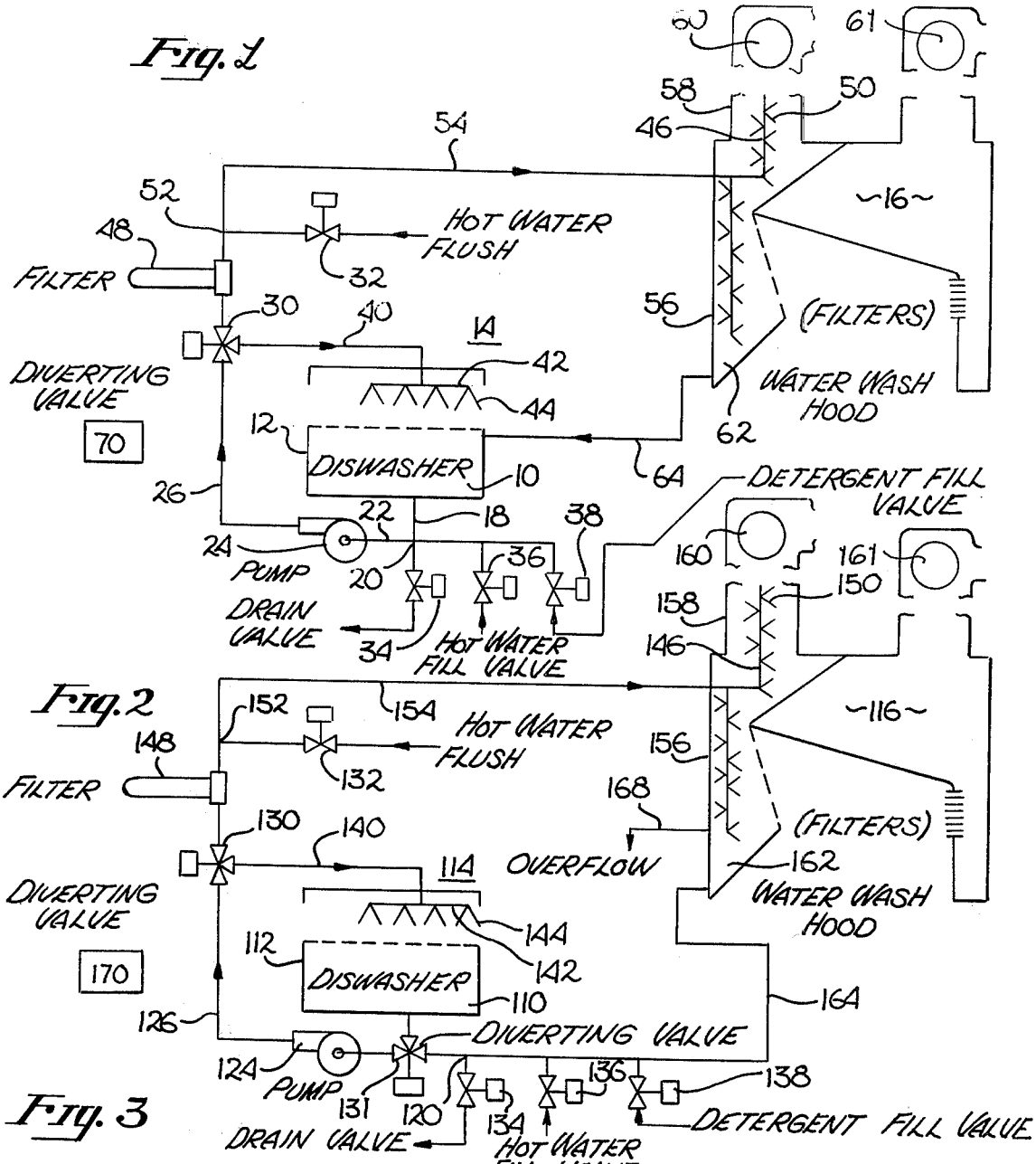
FIG. 1 is a diagrammatic view of one embodiment by which a dishwashing assembly may be combined with a wash hood assembly wherein certain valving, and a pump, together with a sump which is contained within the dishwasher, is used in common between the wash hood assembly and the dishwashing assembly.
FIG. 2 is a diagrammatic view of another embodiment of the present invention wherein a washing system is formed by combining a dishwashing assembly and wash hood assembly by means of certain common valving and pumping wherein the sump is contained within the wash hood assembly and the dishwashing assembly.
FIG. 3 is a table illustrating the coordination of various elements of the present invention whereby a plurality of fill, wash, drain, and flush cycles may be sequenced during the operation of the wash hood.

The present invention is a washing system wherein a dishwasher and wash hood are combined. A washing system combining a dishwasher and wash hood necessitates the use of certain additional valving, to be discussed in detail below, and allows the common use of a single sump and pump. A control means is coupled to the valving to alternatively permit the dishwasher or wash hood to be cycled through a preselected wash, rinse, or flush cycle.

A diagrammatic view of one embodiment, wherein a common sump 10 is housed within a dishwasher enclosure 12, is illustrated in FIG. 1. Dishwasher 14 is illustrated as being a fixed station dishwasher wherein all washing, rinsing, and flushing operations occur at a single location. The diagrammatic illustration of dishwasher 14 is also meant to include a conveyor type dishwasher in which the items to be washed undergo washing, rinsing, and flushing cycles at different locations within the dishwasher, usually while being conveyed through the dishwasher by a continuous belt, system of pawls, or other means well known to the art.

Sump 10 communicates by a plumbing line 18 to a junction 20. It is to be understood throughout the specification that the referenced plumbing lines may be any means through which a fluid may be conveyed under pressure. Typically, this would include metal pipes together with the appropriate fittings, both rigid and flexible hose, PVC piping or other means well known to the prior art. Junction 20 communicates with pump 24 by means of plumbing line 22. The capacity of sump 10 and the performance of pump 24 are chosen to optimize the performance of the entire washing system. In the case where separate prior art wash hoods or dishwashers are retrofitted to conform to the present invention, it is not necessarily expected that the sump capacity or the pump performance will be optimum or even adequate. The particular sump capacitance or pump performance which is selected will depend upon the specific specifications and requirements of each application. The factors which will influence the choice of pump and sump design will include the speed and capacity of the dishwasher, the size of the exhaust duct within the hood, the number and size of spray nozzles disposed within the hood, and the head to which the fluid must be pumped in wash hood 16.

The output of pump 24 communicates by a plumbing line 26 with a diverting valve 30. Diverting valve 30 may be a two way bypass valve having a single input and two output ports, or may be diverting valve assembly comprised of two valves each having a single input and output port, and both having their inputs joined at a single junction.

One output of diverting valve 30 communicates by a plumbing line 40 to a first distributing means 42 disposed within dishwasher 14. Typically, distributing means 42 is an arm having a plurality of jet nozzles 44 arranged in such fashion as to impart a rotary motion to distributing means 42. Many other types of distributing means 42 are well known to the prior art, and which particular type is chosen is not crucial to the present invention. Since the pressure specifications required for a second distributing means 46 disposed within washer 16 may be dramatically different than that for distributing means 42, it may be necessary to install a pressure reducing means in communication with plumbing line 40. In many cases the restriction provided by nozzles 44 is sufficient to reduce the pressure of fluid delivered within enclosure 12 of dishwashing assembly 14. It is also entirely possible that a pressure regulator, well known to the art, may be installed in line 40 to insure proper pressure at nozzles 44 within distributing means 42.

The second output of diverting valve 30 may be coupled to a filter 48 which is designed to entrap particles of food or debris above a certain size without substantially interferring with the flow or pressure through the filter. Such a filter may be necessary to prevent clogging of nozzles 50 which are appropriately arranged on the second distributing means 46 within wash hood 16. Wash hood 16 may also have a means 61 (161 in FIG. 2) for providing make-up air to replace air which is exhausted through exhaust duct 58 (158 in FIG. 2) by exhaust fan 60 (160 in FIG. 2). The output of filter 48 is coupled to a junction 52 which has one port directed to a hot water flush valve 32 and a second port coupled to plumbing line 54. Plumbing line 54 has its other end coupled to distributing means 46. The input port of hot water flush valve 32 communicates with a hot water source, typically at ordinary line pressure. Distributing means 46 is an appropriately disposed piping system within wash hood 16, and is typically contained within exhaust conduit 56 and exhaust duct 58. Distributing means 46 is provided with a plurality of nozzles 50 which direct the delivered fluid in a plurality of jet streams or sprays substantially throughout the entire inner surface of the exhaust portion of wash hood 16. Distributing means 46 may continue upward along the length of exhaust duct 58 and terminate at or near an exhaust fan 60. Thus, it is possible that in some applications distributing means 46 may extend one or more stories above pump 24. As previously mentioned, the number and size of nozzles 50 as well as the height which distributing means 46 extends within exhaust duct 58 will be factors which determine the performance characteristics of pump 24. The lower portion of exhaust conduit 56 is formed into a shallow trough 62.

Fluid disposed within the exhaust portion of wash hood 16 drains by gravity flow to trough 62. Plumbing line 64 communicates trough 62 with sump 10. In addition, as previously mentioned, plumbing line 18 communicates with junction 20. Junction 20 may also be coupled to one port of a drain valve 34 whose other port communicates with a standard drain line typically permanently installed on site. Junction 20 is also coupled to one port of a hot water fill valve 36 which has its other port coupled to a hot water source which again is typically installed on site. Finally, junction 20 may be coupled to one port of detergent fill valve 38 which has its other port communicating with a detergent source. Valves 34, 36 and 38 may in many cases be part of the standard equipment provided with dishwasher 14. In cases where a dishwasher 14 is retrofitted with a wash bond to form a washing system it may be necesary only to install diverting valve 30 and possibly a different pump 24 in order to couple the dishwasher 14 to plumbing line 54 and junction 52.

Pump 24, exhaust fan 60, diverting valve 30, hot water flush valve 32, drain valve 34, hot water fill valve 36, and detergent fill valve 38 may all be coupled to a control means 70 which properly sequences their operation. Control means 70 is of a type generally well known to the art and may in fact be the same control means which is used to control a fixed station dishwasher. In the case where a wash hood is combined with a conveyor type dishwasher it may be necessary to add an additional sequential timer to program the operation of fan 60, pump 24, and the various valves of the embodiment in FIG. 1. The operation of the washing system will be described in more detail below.

A second embodiment of the present invention is diagrammatically illustrated in FIG. 2. The reference characters of each of the elements have been generally assigned a new reference character in a "100 Series" but each element serves a similar function in the embodiment illustrated in FIG. 2 as the corresponding referenced element serves in the embodiment illustrated in FIG. 1. For example, pump 24 of the washing system of FIG. 1 is characterized as pump 124 in FIG. 2, and so forth. The embodiment illustrated in FIG. 2 differs from the embodiment illustrated in FIG. 1 by the utilization of a sump 162, in addition to sump 110, and the addition of an additional diverting valve 131.

The embodiment of FIG. 2 will typically have the lower portion of exhaust conduit 156 substantially enlarged to serve as a sump for the wash hood 116. Sump 110 is still utilized for the dishwasher 114. Whereas in the embodiment of FIG. 1 through 62 communicated with sump 10 by means of plumbing lines 64, in the embodiment of FIG. 2 sump 162 communicates with junction 120 by means of plumbing line 164. There is not direct coupling between sump 162 and dishwasher sump 110. In addition, sump 110 of dishwasher 114 is coupled to a first input of diverting valve 131. Diverting valve 131 also has a second input. The second input is coupled to junction 120 while the output is coupled to the input of pump 124. Thus, by means of valve 131 dishwasher 114 may be isolated from junction 120. Fluid applied to or drained through valves 134, 136, and 138 are directed to sump 162 by plumbing line 164. Since in most cases sump 162 will be at a higher level than the lowest part of dishwasher 114, diverting valve 131 is necessary to prevent undesired backflow into sump 10. It may also be noted that sump 162 may be provided with an overflow port 168 which is diagrammatically illustrated in FIG. 2 as being diposed at an upper portion of sump 162. Overflow port 168 communicates with a standard drain which is typically permanently installed on site. The function of each of the other elements of the embodiment illustrated in FIG. 2 is substantially the same as the correspondingly numbered element of FIG. 1 and therefore will not be repeated.

The operation of the embodiments illustrated in FIGS. 1 and 2 may now be understood by referring to FIG. 3 which is a table illustrating a typical washing sequence of wash hood 16 (116) utilizing the elements of the present invention. Each horizontal row of FIG. 3 corresponds to one of the valves or to fan 60 (160) in the embodiment of FIG. 1 (FIG. 2). The vertical columns correspond to separate steps within the washing sequence of the wash hood. A wash-rinse-flush sequence is illustrated by way of an example only and other sequences well known to the art may be programmed into control means 70 (170). Typically, the operational sequences are "hard wired" by means of fixed circuitry in combination with a timer as is well known to the art. However, a control means may include any other means known to the art including the use of programmable tapes, cards, or the like. The wash cycle consists of a fill, wash, and drain step. The rinse cycle consists of a fill, rinse, and drain, while flush cycle consists of a flush, drain, and finish step. In some applications, the rinse cycle may be eliminated, depending upon the usage of the exhaust hood. The last column of FIG. 3, the finish step, indicates the condition of the various valves and fan 60 (160) during a quiescent interval when neither wash hood nor dishwasher is activated, (normal hood operation).

In the fill step of the wash cycle all the valves of the embodiment of FIG. 1 or FIG. 2 are closed (denoted by the symbol C) except valves 36 and 38 in the case of FIG. 1 and valves 136 and 138 in the case of FIG. 2. Fan 60 (160) is on (denoted by the symbol O) when hot water fill valve 36 (136) is opened together with detergent fill valve 38 (138). A soapy solution may then be discharged into sump 10 (162). In the embodiment of FIG. 2 the valve 131 is closed so that the hot detergent solution is disposed within sump 162 by means of plumbing line 164.

After a timed interval or an interval as determined by a level indicator appropriately disposed in the sump, control means 70 (170) then initiates the wash step of the wash cycle and valves 38 (138) and 36 (136) are closed. Diverting valve 30 (130) is opened together with second diverting valve 131 in the embodiment of FIG. 2. Hot, detergent solution is then circulated through distributing means 46 (146), nozzles 50 (150) and exhaust duct 58 (158) by pump 24 (124). The solution is returned by gravity flow to sump 10 (162) to be later recirculated by pump 24 (124). All other valves remain closed and fan 60 (160) is deactivated. It is an important element of the present invention that fan 60 (160) be deactivated during the wash and rinse steps. Fan 60 (160) draws a substantial quantity of air through exhaust duct 58 (158). If fluid were permitted to be discharged within exhaust duct 58 (158) the wash hood would tend to operate as an evaporative air conditioner or cooler. Thus, the temperature of the wash or the rinse water, which is an important factor in washing efficiency, would be drastically reduced due to evaporative cooling.

After a preselected time interval control means 70 (170) terminates the wash step and initiates the drain step of the wash cycle wherein all of the valves are closed except for drain valve 34 (134). Gravity flow will now cause the substantially spent hot detergent solution to drain into sump 10 (162) (and eventually through drain valve 34 (134) into a standard on-site drain. During this interval fan 60 (160 ) may be turned back on to resume the normal operation of the wash hood.

After a sufficient time has elapsed to allow the detergent solution to entirely drain from sump 10 (162), control means 70 (170) initiates a fill step which is the first step of the rinse cycle. Fan 60 (160) may remain on and all the valves are closed except hot water fill valve 36 (136). Again sump 10 (162) will fill a with a hot clean water solution.

After sump 10 (162) has sufficiently filled, control means 70 (170) will initiate the rinse step during which fan 60 (160) will again be turned off. Diverting valve 30 (130) and second diverting valve 131 in the embodiment of FIG. 2 will again be opened as in the prior wash step of the wash cycle. Hot clean rinse water will be circulated from sump 10 (162) through pump 24 (124) and into the fluid distributing means 46 (146) to be returned by gravity flow to sump 10. (162).

After a sufficient time interval has elapsed control means 70 (170) deactivates pumps 24 (124) and reactivates fan 60 (160). All the valves are again closed with the exception of drain valve 34 (134) through which the spent rinse water is drained by gravity flow into an on-site standard drain. After the rinse water has been drained from sump 10 (162), hot water flush valve 32 (132) is activated by control means 70 (170) while drain valve 34 (134) remains open. Clean hot water at approximately 140 - 180 degrees Fahrenheit is then circulated through distributing means 46. The hot flush water is basically at ordinary line pressure. Fan 60 (160) is again deactivated during the flush step in order to prevent evaporative cooling of the flush water. After a sufficient time interval has elapsed the hot water flush valve 32 (132) is closed and the spent flush water is drained by gravity flow into an on-site standard drain. After a sufficient time for draining has elapsed drain valve 34 (134) are closed and fan 60 (160) is reactivated to return the wash hood to its normal operating mode.

Thus, it may be appreciated that any number of wash and rinse or flush cycles may be programmed by control means 70 (170) using the elements of the present invention to combine a wash hood and dishwasher into a single washing system. It may also be appreciated that to a certain extent, the nature and number of elements of the present invention are dictated by the nature of the wash, rinse, and flush cycles which are programmed for either wash hood 16 (116) or dishwasher 14 (114).

Furthermore, hot water flush valve 32 (132) may also be activated by an automatic or manual fire control system incorporated in wash hood assembly 16 (116). Therefore, the flush step of the flush cycle may be initiated at any time to control grease fires which might occur within wash hood assembly 16 (116).

Throughout the above specification it has been assumed that each of the steps within a wash, rinse, or flush cycle was initiated and controlled by control means 70 (170). It is entirely within the scope of the present invention, that the operation of washing system may not be entirely automatic, but may be entirely or in part manually operated. For example, many conventional dishwashers may require a solid detergent to be manually loaded. In addition, hot water fill valve 36 (136) may be manually activated. This manual operation is entirely consistent with a concurrent automatic operation in which wash hood assembly 16 (116) may be loaded with liquid detergent or hot water as controlled by control means 70 (170).

Thus, it can readily be appreciated that various modifications and combinations of the elements of the present invention may be made by those having ordinary skill in the art without departing from its scope and spirit.

We claim:

1. A washing system comprising:

a dishwashing assembly having a pump means for supplying a plurality of fluids under pressure;

a wash hood assembly having a duct, a hood, a fan, and a means for selectively disposing one of said plurality of fluids within said wash hood assembly, said dishwashing assembly communicating with said wash hood assembly through a bypass valve; and control means including (1) means for selectively delivering one of said plurality of fluids to said dishwashing assembly and to said wash hood assembly; and (2) means for controlling said fan, pump, and bypass valve to selectively cleanse said wash hood assembly; and (3) means to operate said dishwashing assembly.

2. The washing system of claim 1 wherein:

said duct, hood, and fan of said wash hood assembly is an exhaust duct, exhaust hood, exhaust fan respectively and said wash hood assembly has a means for providing make-up air; and said control means also selectively including (4) means for controlling said means for providing make-up air.

3. The washing system of claim 1 wherein:

said control means also includes (5) a pressure control means for modifying the amount of pressure of said one of the plurality of fluids supplied by said pump means.

4. The washing system of claim 1 wherein said means (1) for selectively delivering said plurality of fluids delivers said fluids according to a single timing cycle.

5. The washing system of claim 1 wherein said means (1) for selectively delivering said plurality of fluids delivers said fluids according to a selected one of a plurality of timing cycles.

6. A washing system comprising:

a dishwashing assembly having a pump means for supplying a plurality of fluids under pressure;

a wash hood assembly having an exhaust duct, an exhaust hood, an exhaust fan, and first means for selectively disposing one of said plurality of fluids within said wash hood assembly; and second means coupled between said dishwashing and wash hood assemblies for selectively delivering at least one of said plurality of fluids to said dishwashing assembly and to said wash hood assembly according to one selected timing cycle selected from a plurality of timing cycles suitable for said dishwashing and wash hood assembly, said second means including (1) means for controlling said exhaust fan, and (2) means for controlling said dishwashing assembly.

7. The washing system of claim 6 wherein said wash hood assembly has a third means for providing make-up air, said second means including (3) means coupled and controlling said third means for providing make-up air.

8. A method for washing an exhaust hood assembly in combination with a dishwashing assembly and a sump, said exhaust hood assembly including an exhaust duct, an exhaust hood and an exhaust fan, comprising the steps of:

deactivating said exhaust fan;

activating at least one fill valve to deliver a detergent solution to said sump, said fill valve communicating with said sump;

activating a pump and a bypass valve, said bypass valve to divert said detergent solution from said dishwashing assembly to said exhaust hood assembly, said pump to recirculate said detergent solution from said sump through said bypass valve to said exhaust hood assembly and back to said sump;

deactivating said pump;

draining part of said detergent solution into said sump; and removing said detergent solution from said sump by activating a drain valve coupled to said sump.

9. The method of claim 8 wherein each of the steps may be repeated in sequence in a plurality of repetitions and then further comprising the steps of:

activating a flush valve coupled to said exhaust hood assembly to rinse said exhaust assembly with clean water under pressure to remove substantially all of said detergent solution from said exhaust hood assembly; and draining said clean water from said exhaust hood assembly into said sump to remove substantially all of said detergent solution from said sump.

10. The method of claim 8 wherein each of the steps is initiated by a control means for timing, sequencing, and controlling said exhaust fan, fill valve, pump, and bypass valve.

11. The method of claim 8 further comprising deactivating a make-up air fan when said exhaust fan is deactived.

12. A washing system comprising:

a dishwashing assembly having an enclosure and a first means for distributing fluid under pressure within said enclosure;

a wash hood assembly having an exhaust duct, exhaust fan, and a second means for distributing under pressure within said exhaust duct;

a sump communicating with said wash hood assembly;

a pump having its input communicating with said sump;

means for disposing detergent within said sump, said means communicating with said sump;.

third means for supplying hot water, said means communicating with said sump through a hot water fill valve;

a drain communicating with said sump through a drain valve;

a bypass valve having an input and two outputs, said input communicating with the output of said pump, one of said outputs of said bypass valve communicating with said first means for distributing fluid, the other of said outputs communicating with said second means for distributing fluid; and fourth means for supplying hot water, said fourth means communicating with said second means for distributing fluid, said fourth means for distributing fluid through a hot water flush valve.

13. The washing system of claim 12 further comprising:

control means communicating with said pump, exhaust fan, bypass valve, drain valve, hot water fill valve, hot water flush valve, and means for disposing detergent within said sump, said control means for selectively activating said pump, exhaust fan, bypass valve, drain valve, hot water fill valve, hot water flush valve, and means for disposing detergent in a selected one of a plurality of sequences to selectively wash, rinse, and flush said wash hood assembly and dishwashing assembly.

14. The washing system of claim 13 wherein:

said sump is contained within said enclosure of said dishwashing assembly.

15. The washing system of claim 13 wherein said sump is included within said wash hood assembly.

16. The washing system of claim 13 wherein said sump is separate from said dishwashing and said wash hood assembly.

17. A washing system comprising:

a dishwasher assembly having a pump means for supplying a plurality of fluids under pressure, wherein said pump means is coupled to a bypass valve having at least two outlet ports, a first of said outlet ports coupled to a pressure modification means for altering the pressure of fluid flowing therethrough, said pressure modification means being coupled to said dishwashing assembly;

a wash hood assembly having an exhaust duct, an exhaust hood, an exhaust fan, and means for selectively disposing one of said plurality of fluids within said wash hood assembly, a second of said outlet ports of said pressure modification means being coupled to said wash hood assembly; and control means coupled between said dishwashing and wash hood assemblies and to said bypass valve, said controlling means including (1) means for selectively delivering one of said plurality of fluids to said dishwashing assembly and to said wash hood assembly according to a selected timing cycle selected from a plurality of timing cycles and at a selected pressure, (2) means for controlling said exhaust fan, (3) and means for controlling said dishwasher assembly.

* * * * *